US005640658A

United States Patent [19]

Inoue et al.

[11] Patent Number: 5,640,658

[45] Date of Patent: Jun. 17, 1997

[54] IMAGE FORMING APPARATUS CAPABLE OF FORMING IMAGE ON BOTH SURFACES OF RECORDING MATERIAL

[75] Inventors: Masahiro Inoue, Yokohama; Takahiro Kubo, Tokyo; Yasuo Nami, Kawasaki; Ikuo Kuribayashi, Tokyo, all of Japan

[73] Assignee: Canon Kabushiki Kaisha, Tokyo, Japan

[21] Appl. No.: 709,628

[22] Filed: Sep. 9, 1996

Related U.S. Application Data

[63] Continuation of Ser. No. 127,882, Sep. 28, 1993, abandoned.

[30] Foreign Application Priority Data

Sep. 30, 1992 [JP] Japan ..... 4-261913
Oct. 16, 1992 [JP] Japan ..... 4-305009

[51] Int. Cl.[6] ..... G03G 15/16

[52] U.S. Cl. ..... 399/298

[58] Field of Search ..... 355/271, 273, 355/274, 326 R

[56] References Cited

U.S. PATENT DOCUMENTS

| | | | |
|---|---|---|---|
| 4,872,037 | 10/1989 | Kasahara et al. | 355/271 |
| 4,873,541 | 10/1989 | Hirose et al. | 346/153.1 X |
| 4,914,737 | 4/1990 | Amemiya et al. | 355/274 X |
| 4,998,143 | 3/1991 | Kumasaka et al. | 355/271 |
| 5,012,293 | 4/1991 | Aldrich et al. | 355/274 |
| 5,040,026 | 8/1991 | Jamzadeh et al. | 355/271 |
| 5,043,761 | 8/1991 | Johnson | 355/271 X |
| 5,049,943 | 9/1991 | Menjo et al. | 355/284 |
| 5,091,751 | 2/1992 | Inoue et al. | 355/274 |
| 5,187,536 | 2/1993 | Hasegawa et al. | 355/271 X |
| 5,202,727 | 4/1993 | Izumizaki et al. | 355/211 |
| 5,239,347 | 8/1993 | Onodera et al. | 355/274 |

*Primary Examiner*—Fred L. Braun
*Attorney, Agent, or Firm*—Fitzpatrick, Cella, Harper & Scinto

[57] ABSTRACT

An image forming apparatus includes an image bearing member; recording material carrying member for carrying a recording material, wherein the recording material carried on the recording material carrying member is urged to the image bearing member while an image on the image bearing member is transferred, in a transfer station, onto the recording material carried on the recording material carrying member; a rotary fixing member which is coated with a parting agent, and is contacted with an unfixed image on the recording material; and a backup member for forming a nip in conjunction with the rotary fixing member, wherein the recording material is conveyed through the nip to fix the image onto the recording material; wherein after fixing the image on the first surface of the recording material, the apparatus is capable of forming the image on the second surface, which is the opposite surface to the first surface and a separating device for separating the image bearing member and the recording material carrying member after the image is transferred onto the second surface of the recording material.

22 Claims, 15 Drawing Sheets

IMAGE FORMING APPARATUS CAPABLE OF FORMING IMAGE ON BOTH SURFACES OF RECORDING MATERIAL

This application is a continuation of application Ser. No. 08/127,882, filed Sep. 28, 1993, now abandoned.

FIELD OF THE INVENTION AND RELATED ART

The present invention relates generally to an image forming apparatus, in particular, an image forming apparatus in which an image formed on an image bearing member by an electrophotographic process or electrostatic recording process is transferred onto a recording material carried on a recording material carrying member. As for such an image forming apparatus, there are an electrophotographic black-and-white, monochromatic, or full-color copying machine, printer, and also, various other recording apparatuses.

It is known that in the color image forming apparatus, a toner image borne on a photosensitive drum, which is the image bearing member, is transferred onto the recording material carried on a transfer drum, which is the recording material carrying member, and then, the image is fixed on the recording material by a fixing means coated with a separating agent for preventing off-setting.

However, it was discovered that there were the following inconveniences, as the results of the experiments conducted by the inventors, in which such a fixing means coated with the separating agent as described above was employed for an operation to form an image on both surfaces of a recording material, in which the toner image was transferred onto one of surfaces of the recording material and was fixed by the fixing means, and next, the toner image was transferred onto the back side of the same recording material and was fixed.

When the toner image formed on the first surface of the recording material was fixed during a double side image forming operation, oil, which was the separating agent, migrated from a heating roller to the first surface on which the unfixed toner image was transferred during the first transferring operation. Then, the same recording apparatus was fed to have the image formed on the back surface, when the first surface on which the toner image had been fixed (that is, the surface to which the oil had adhered) during the first image forming operation came in contact with the surface of the transfer drum. As a result, the oil adhering to the toner image or the recording material itself migrated onto the recording material carrying sheet as the recording material was wrapped around the transfer drum, and then, the oil, which was then on the transfer drum, migrated to the photosensitive drum as the transfer drum continued its rotation after the recording material was separated from the transfer drum.

When the oil migrates onto the photosensitive drum in the above described manner, it may become impossible for the cleaning apparatus to remove the oil, whereby it may become impossible for the cleaning apparatus to remove the toner, or the toner may adheres to the oil, on the areas where the latent image is not, which ultimately leads to production of a dirty print soiled by the unwanted toner during subsequent image forming operations, which has been the problem.

SUMMARY OF THE INVENTION

Accordingly, a principal object of the present invention is to provide an image forming apparatus capable of preventing a separating agent from migrating from a recording material carrying member to an image bearing member.

According to an aspect of the present invention, the image forming apparatus in accordance with the present invention is capable of preventing the deterioration of the image caused by the adhesion of the separating agent to the image bearing member.

According to another aspect of the present invention, the image forming apparatus is capable of forming the image on both surfaces of the recording material.

These and other objects, features, and advantages of the present invention will become more apparent upon a consideration of the following description of the preferred embodiments of the present invention, taken in conjunction with the accompanying drawings.

DETAILED DESCRIPTION OF THE PREFERRED EMBODIMENTS

Figure 1:
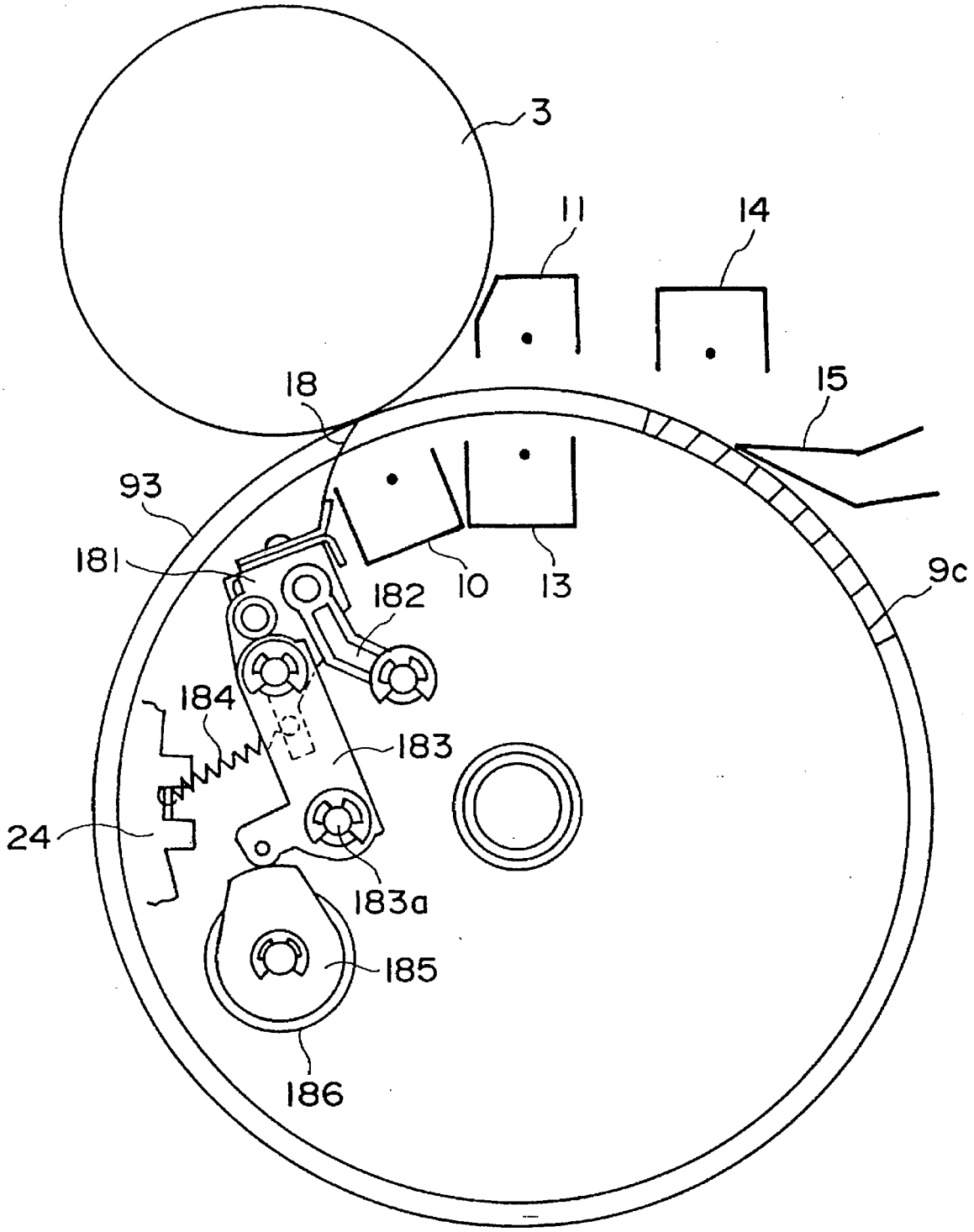
FIG. 1 is a sectional view of a pressure generating mechanism of a pressing member in the image forming apparatus in accordance with the present invention.

Hereinafter, the embodiments of the present invention will be described, referring to the drawings.

Figure 6:
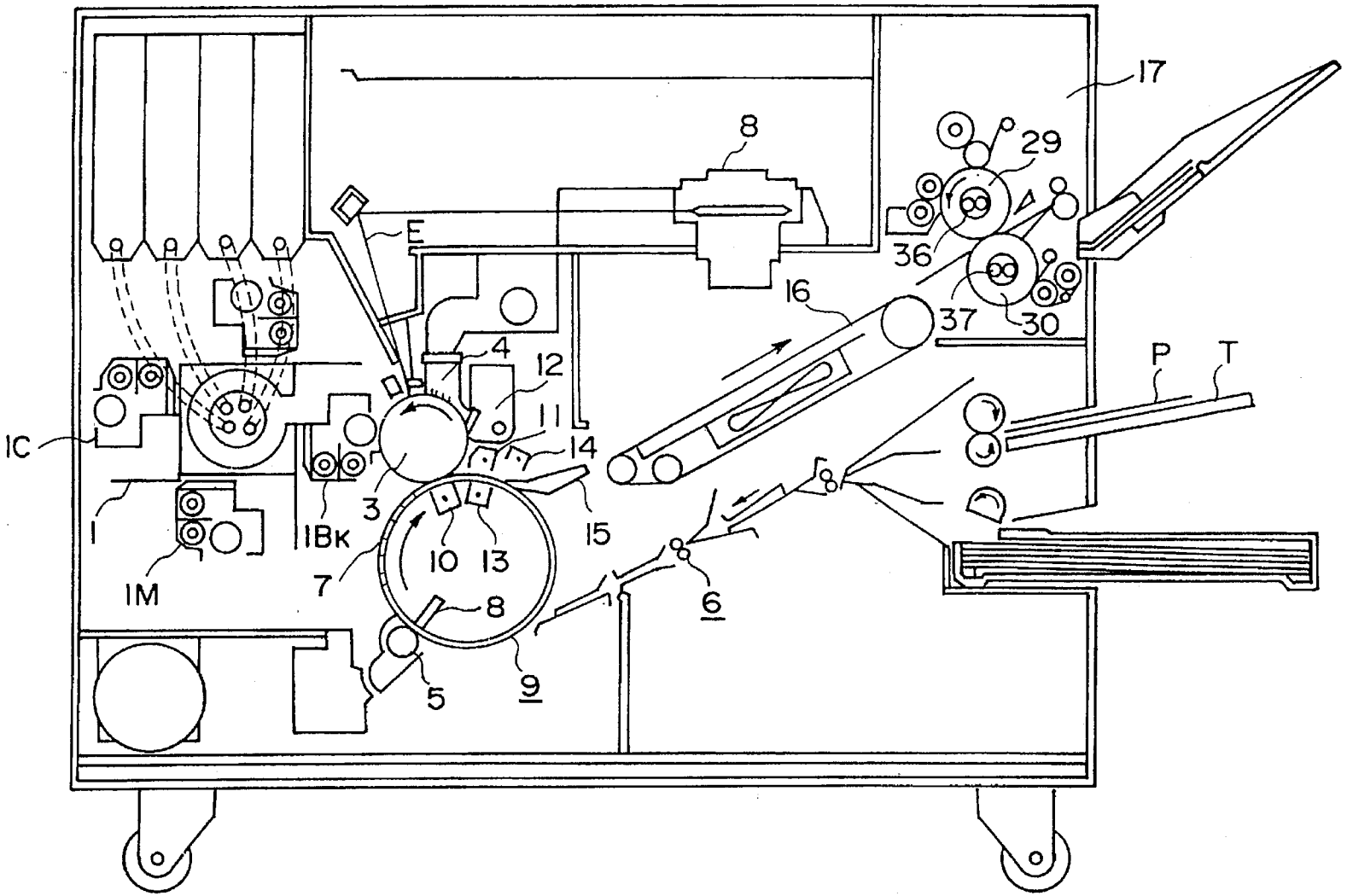
FIG. 6 is a sectional view of a preferred embodiment of the image forming apparatus in accordance with the present invention.

FIG. 6 illustrates, as an image forming apparatus, an electrophotographic multicolor copying machine comprising a so-called rotary developing apparatus.

Referring to FIG. 6, the electrophotographic multicolor image forming apparatus comprises an image bearing member, that is, a photosensitive drum 3, the axis of which is supported by bearings so that it can be rotated in the direction indicated by an arrow, and an image forming means disposed in the vicinity of the circumferential surface of the photosensitive drum 3. The image forming means may be optionally chosen, but in this embodiment, it comprises: a primary charger 4 for charging uniformly the photosensitive drum 3; an exposing means 8, such as a laser beam exposing means, for irradiating an exposure beam modulated in response to imaging signals representing optical images generated through the color separation, or in response to equivalent signals; and a rotary developing apparatus 1 for visualizing the electrostatic latent image borne on the photosensitive drum 3.

The rotary developing apparatus 1 comprises: four developing devices 1M, 1C, 1Y, and 1BK, each of which contains one of different developers, respectively, which are a magenta color developer, cyan color developer, yellow color developer, and black color developer; and a substantially cylindrical frame, of which axis is rotatively supported by bearings. In the rotary developing apparatus 1, a selected developing device is positioned by the rotation of the frame, at a developing station where this selected developing device comes to face the circumferential surface of the photosensitive member, so that the electrostatic latent image is developed, and the repetition of this sequence produces a full-color image composed of four colors.

Figure 7:
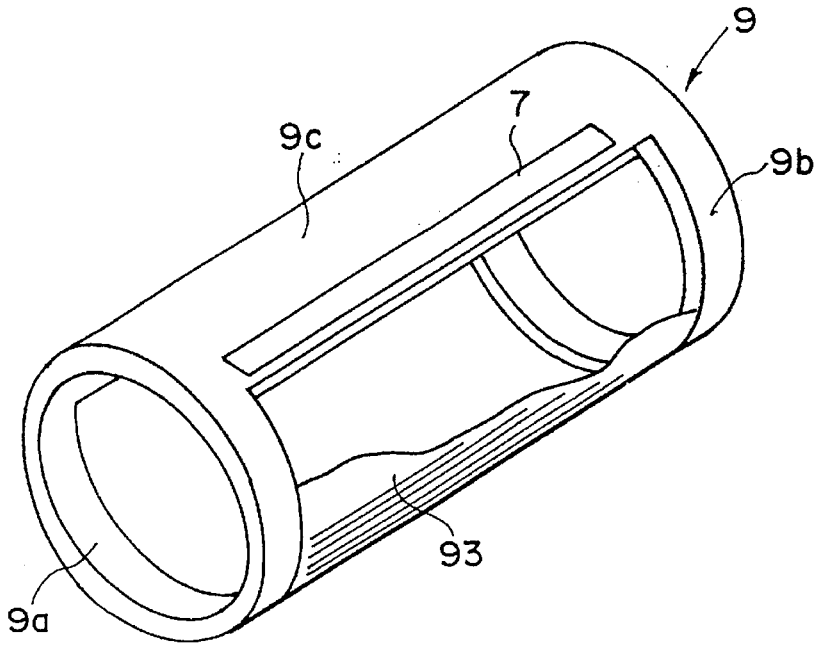
FIG. 7 is a perspective view of a transferring apparatus.

The visible image borne on the photosensitive drum 3, that is, the toner image, is transferred onto a transfer material P being carried on a transferring apparatus 9. In this embodiment, the transferring apparatus 9 is a transfer drum, the axis of which is rotatively supported by bearings. As can be understood by referring to FIG. 7, the transfer drum comprises cylinders 9*a* and 9*b* located at the opposite ends and a connecting member 9*c* bridging the cylinders 9*a* and 9*b*. The circumferential opening between the cylinders 9*a* and 9*b* is covered with a recording material carrying member 93 stretched between two cylindrical members. The cylinders 9*a* and 9*b*, and the connecting member 9*c* are made of conductive material such as metal. As for the material for recording material carrying member 93, a dielectric sheet of film, for example, polyethylene terephthalate film or polyvinylidene fluoride resin film, is usually employed. On the connecting member 9*c*, a recording material gripper 7 is provided for gripping the recording material delivered from a sheet feeding apparatus. There is a small gap between the gripper 7 and the connecting member 9, in which the leading end of the recording material is held. Also, within and outside the transfer drum 9, there are a transfer charger 10, a charge removing internal charger 13 which constitutes a charge removing means, and charge removing external chargers 11 and 14.

Figure 8:
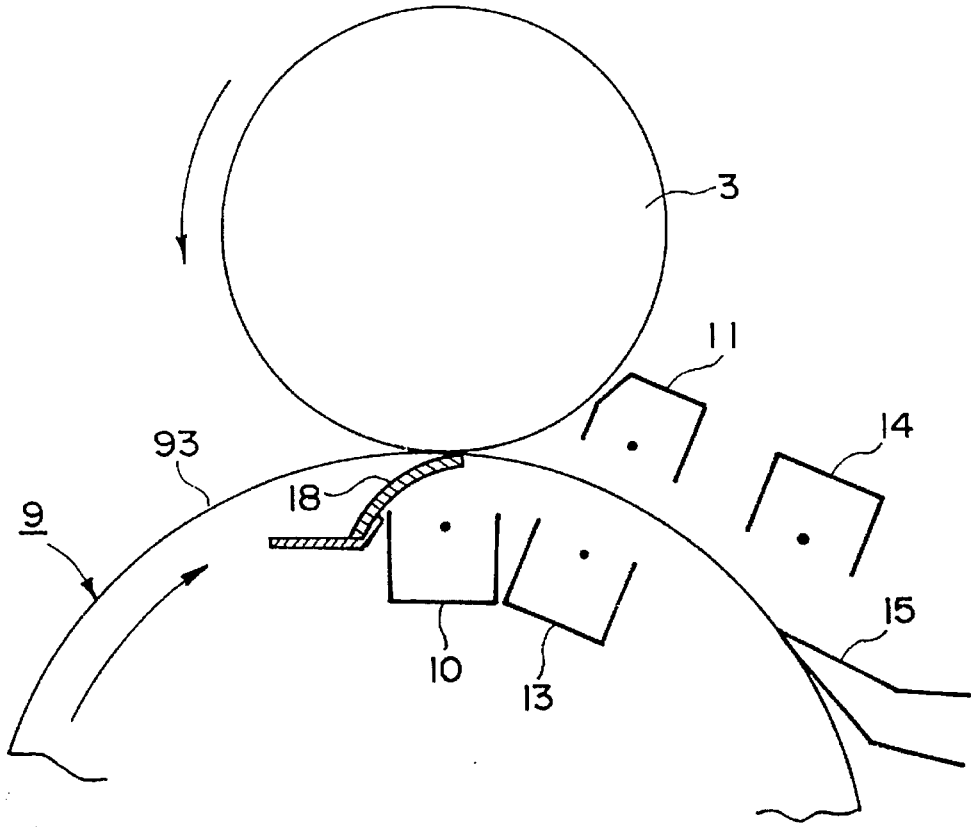
FIG. 8 is an enlarged sectional view of a transfer station and the adjacent components.
Figure 9:
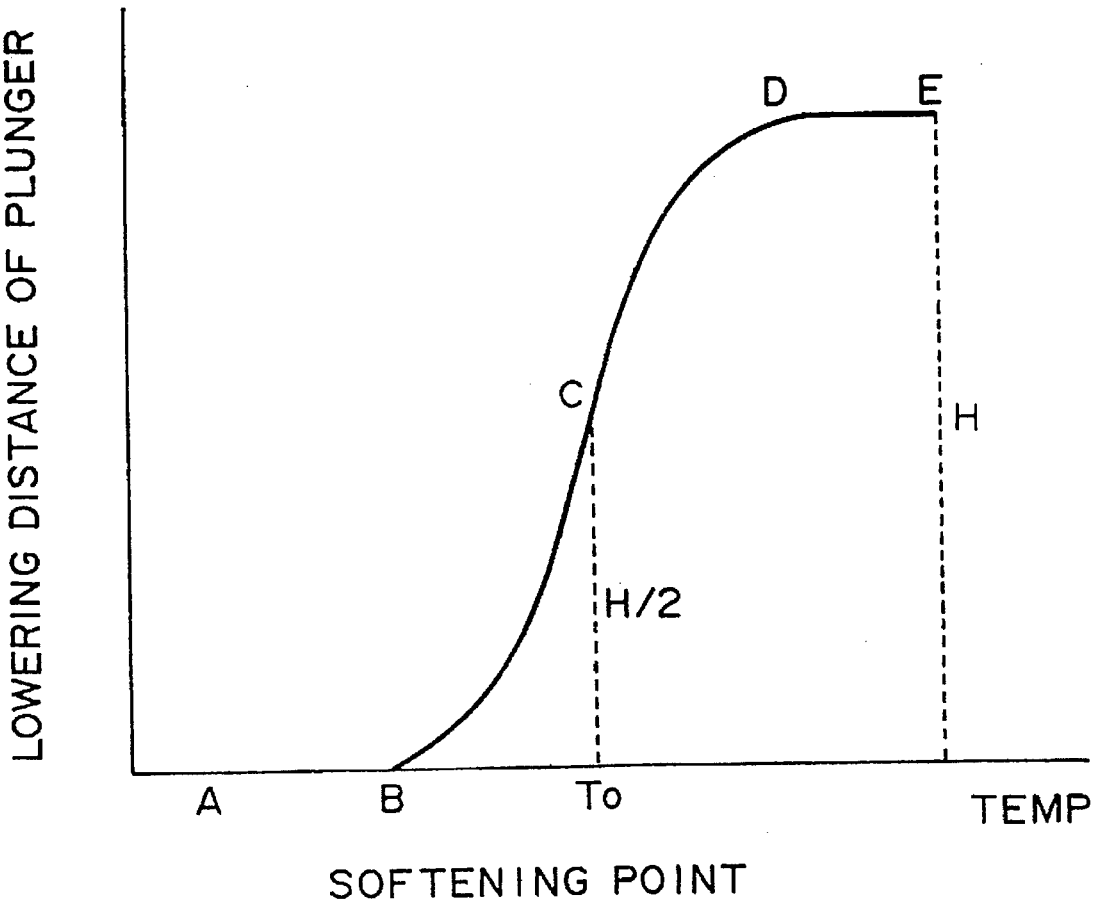
FIG. 9 is a graph depicting the softening characteristic of a sharp-meltable toner in the embodiment of the image forming apparatus in accordance with the present invention.

In addition, in order to increase transfer efficiency so that a crisp image can be transferred, an elastic sheet 18, that is, a pressing member, is provided as a pressure generating means for pressing the dielectric sheet 92 toward the photosensitive drum. This elastic sheet 18 is situated on the upstream side of the transfer charger 10, with reference to the rotational direction of the transfer drum 9, as shown in FIG. 8, and is supported by a supporting member in a manner to extends upward, leaning in the downstream direction, to come in contact with the dielectric sheet 93.

Next, an image forming process will be briefly described, in which a full-color image is formed using an electrophotographic copying machine incorporating the above described structure.

First, the photosensitive drum 3 is uniformly charged by the primary charger 4, and is exposed, by an exposing means, to a scanning beam E modulated in response to imaging data, whereby an electrostatic latent image is formed on the photosensitive drum 3. This latent image is visualized by the rotary developing apparatus 1, as a toner image, on the photosensitive drum 3, wherein the average particle diameter of the toner composing this toner image is 8 μm and its base material is resin.

On the other hand, a recording material P is released to the transfer drum 9 in synchronization with the image, by a register roller 6 is gripped by the gripper 7 or the like by the leading end; and is carried by the transfer drum 9 in the direction indicated by an arrow in the drawing.

Next, in a region where the recording material P comes in contact with the photosensitive drum 3, the recording material P is subjected to corona discharge having a polarity opposite to that of toner, by the transfer charger 10, whereby the toner image borne on the photosensitive drum 3 is transferred onto the recording material P. At this time, the corona discharge is induced from behind the recording material carrying member, that is, the dielectric sheet 93, by the transfer charger 10 imparted with a voltage from a power source.

After the completion of the transfer process in which a necessary number of toner images are transferred onto the recording material P, the recording material P is subjected to the charge removing chargers 11, 13, and 14 is separated by the function of a separating claw 15; and is conveyed to a fixing device 17 by a conveyer belt 16. The superimposed toner images on the recording material P are mixedly fused, that is, fixed, by the heat of the fixing device 17, and is discharged out of the apparatus.

On the other hand, the photosensitive drum 3 is cleared of the residual toner on its surface by a cleaning apparatus 12, and then, is again subjected to the image forming process.

Also, after the trailing end of the recording material passes through the transfer station, in other words, after the completion of the transfer process, the dielectric sheet surface of the transfer drum 9 is cleaned by a cleaning apparatus 5 comprising a fur brush or the like, and an auxiliary cleaning means 8, and then, is again subjected to the image forming process.

At this time, an operational speed of the fixing apparatus 17 (recording material conveyance speed is 90 mm/sec which is slower than the process speed (peripheral velocity of the photosensitive drum during the image formation) of t e main assembly of the machine, that is, 160 mm/sec. This is because, when the unfixed toner images superimposed in two to four layers are mixedly fused as will be described later, a sufficient amount of heat must be given to the toner. In other words, the amount of heat to be given to the toner is increased by fixing the toner images at a slower speed than the process speed of the main assembly.

Since the color image is composed of two or more toner images superimposed in two to four layers as was previously described, the electrophotographic color copying machine is different from the monochromatic machine in the following two characteristics.

The first point is related to the toner used with the machine.

The toner is required to display good fusibility and mixability when subjected to heat. Therefore, toner having a sharp-melt characteristic, that is, having a low softening point and a low degree of melt viscosity, is used for this purpose. The use of such sharp-melt toner can widen the color reproduction range and can offer a color copy which is faithful to an original of full-color, or which has two or more colors.

The sharp-melt toner is produced by fusing, kneading, pulverizing and classifying a mixture of binder resin material such as polyester resin or styrene-acrylic ester resin material or the like, coloring agent (dye, sublimating dye) and electrification control agent. As desired, the toner powdery may contain various materials such as hydrophobic colloidal silica.

From the standpoint of the fixing characteristics and the sharp melting characteristics, the color toner preferably uses polyester resin material as a binder resin material. The sharp melting polyester resin includes for example a high polymer having ester linkage in the principal chain of molecules synthesized from diol compound and dicarboxylic acid.

In view of sharp melting characteristics, particularly preferred resins may be polyester resins obtained through polycondensation of at least a diol component selected from bisphenol derivatives represented by the formula:

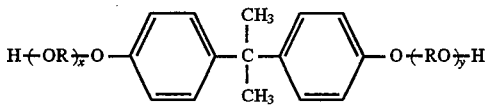

wherein R denotes an ethylene or propylene Group; x and y are respectively a positive integer of 1 or more providing the sum (x+y) of 2 to 10 on an average and their substitution derivatives, and a two- or more-functioned carboxylic acid component or its anhydride or its lower alkyl ester, such as fumaric acid, maleic acid, maleic anhydride, phthalic acid, terephthalic acid, trimellitic acid, pyromellitic acid and mixtures thereof.

Figure 2:
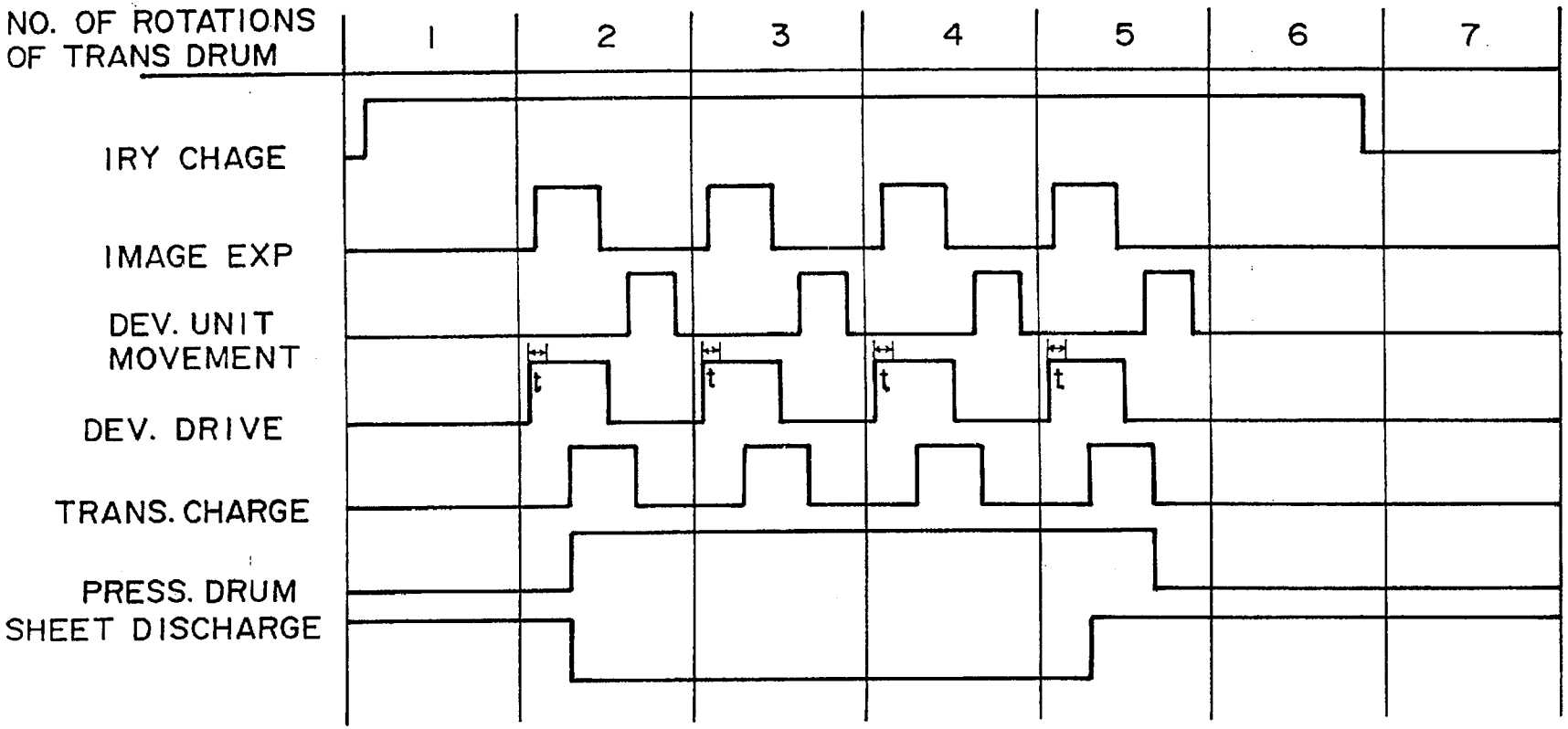
FIG. 2 is an operational sequence of the image forming apparatus in accordance with the present invention.

The softening point of the polyester resin is 75°–150° C., preferably 80°–120° C. FIG. 2 shows the softening characteristics of the toner containing the polyester resin as the binder resin. The measuring method of the softening point in this embodiment will be described.

A flow tester CFT-500A, available from Simazu Seisakusho, is used which has a die (nozzle) having a diameter of 0.2 mm and a thickness of 1.0 mm with the pressing load of 20 Kg. The initial temperature is set 70° C., and preliminary heating period is 300 sec. After the preliminary heating, the temperature is increased at the constant speed of 6° C./min. Then, the amounts of the plunger lowering are plotted relative to the temperature on the lowering amount vs. temperature curve (softening S curve). The weight of the toner is 1–3 g (precisely weighted) and the sectional area of the plunger is 1.0 $cm^2$. The softening S curve is as shown in FIG. 2. With the constant speed temperature increase, the toner is gradually heated, and it starts to flow (A-B). With further increase of the temperature, the fused toner flows out further (B-C-D) until the plunger lowering stops (D-E).

The height H of the S curve represent the total amount flown out, and the temperature T0 corresponding to the point C( H)/2 is the softening point of the material (toner).

Whether the toner and the binder resin have the sharp melt characteristics or not, can be determined on the measurement of the apparent fusing viscosity of the toner or the resin.

In this embodiment, the toner or the binder resin having the sharp melting characteristics means the toner satisfying the followings:

$$T1=90–150° C.$$

$$|\Delta T|=|T1-T2|=5–20° C.$$

where T1 is the temperature at which the apparent fusing viscosity is $10_3$ poise, and $T_2$ is a temperature at which it shows $5\times10_2$ poise.

The sharp melting resin material having such a temperature-viscosity characteristics is characterized by the sharp viscosity decrease when being heated. The viscosity decrease brings about the proper mixing between the topmost toner layer and the bottommost toner layer, the abrupt increase of the transparency of the toner layers themselves, and therefore, the subtractive color mixture properly occurs.

The sharp melting color toner has strong affinity, and therefore, the toner off-set tends to occur. Therefore, in the fixing apparatus for the image forming apparatus using such a color toner, high parting property is desired to last long.

Hereinafter, referring to FIG. 10, the fixing apparatus 17 in accordance with the embodiment of the present invention will be described.

The fixing roller 29, that is, the fixing means, comprises: a metallic core 31 of aluminum, a HTV (high temperature vulcanized) silicone rubber layer 32 coated thereon, and a RTV (room temperature vulcanized) silicone rubber layer 33 coated thereon, and its measurements are 3 mm in thickness (rubber layer 32 plus rubber layer 33) and 40 mm in diameter (the entire roller).

On the other hand, the pressure roller 30, that is, the pressing means, comprises: a metallic core 34 of aluminum 34, a 1 mm thick HTV silicone rubber layer coated thereon, and a RTV silicone rubber layer 35 coated thereon, and its diameter is 40 mm.

The fixing roller 29 contains a halogen heater 36 which is a heating means, and the pressure roller 30 also contains a heater 37 in the metallic core 34 in the same manner as the fixing roller 29, whereby the heat is given from both sides of the material to be heated. The temperature of the pressure roller 30 is detected by a thermistor placed in contact with the pressure roller 30, and in response to the detected temperature, the halogen heaters 36 and 37 are controlled by a controller 39, so that both temperatures of the fixing rollers 29 and the pressure roller 30 are kept at approximately 170° C. The fixing roller 29 and pressure roller 30 are caused to press each other with a total pressure of approximately 40 kg by an unshown pressing mechanism.

Figure 10:
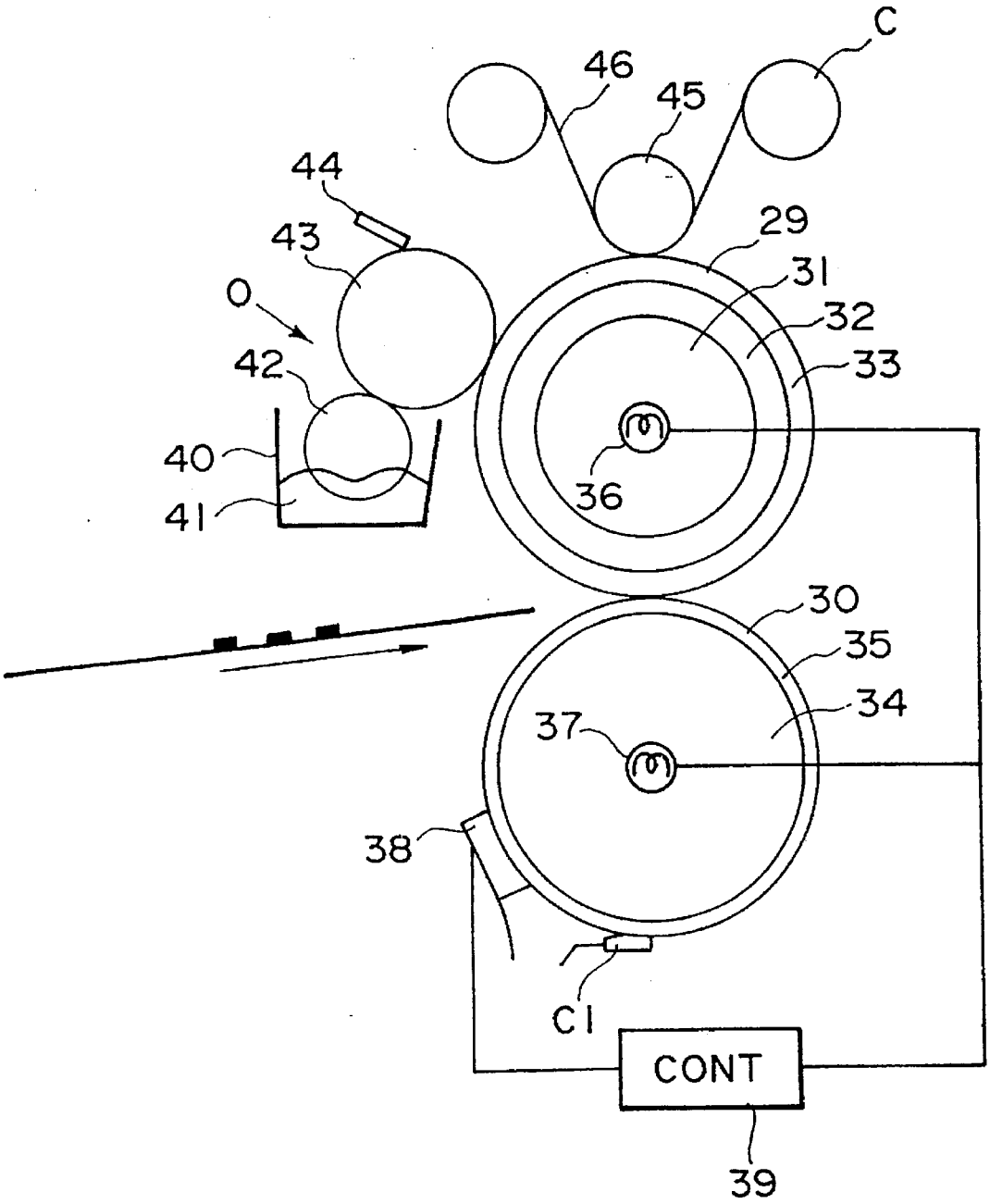
FIG. 10 is a sectional view of a fixing apparatus incorporated in the embodiment of the image forming apparatus in accordance with the present invention.

Referring to FIG. 10, a reference code O designates an oil coating apparatus which serves as a means for coating the parting agent; a reference code C, a cleaning apparatus; and a reference code C1 designates a cleaning blade for removing the oil contamination of the pressure roller 30. In the oil coating apparatus O, dimethyl silicone oil 41 (KF96 300 cs, available from Shinetsu Kagaku Kogyo Kabushiki Kaisha, Japan) in an oil pan 40 is picked up by an oil pick up roller 42, is transferred onto an oil coating roller 43, where its amount is regulated by a blade 44 for regulating the amount of the oil to be coated, and then, is coated on the fixing roller 29. In this embodiment, the amount of oil to be coated is regulated to be 0.08 g/A4, using a measuring method which will be described later.

The amount of the silicone oil to be coated by the oil coating apparatus O is determined in the following manner.

First, the weight of 50 sheets of A4 size white paper which are to be used as the recording materials is measured, and this weight is designated as $A_1$ (g), and the weight of the same 50 sheets is measured after they are passed between the fixing roller 29 and pressure roller 30, without transferring an image on these white sheets of paper, and without coating the silicone oil on the fixing roller 29, and this weight is designated as B(g). Next, the weight of another set of 50 sheets of the same A4 size white paper is measured, and this weight is designated as $A_2$ (g), and then, they are measured after being passed between the fixing roller 29 and pressure roller 30, with the silicone oil being coated on the rubber layer, but without transferring the image on these white sheets, and this weight is designated as C(g).

Then, an amount X(g) of the coated silicone oil per sheet of A4 size white paper can be obtained by the following equation.

$$X=(C+A_1-B-A_2)/50$$

As for the cleaning apparatus C, a web 46 of Nomex (trade name), which is non-woven fabric, is pressed on the fixing roller 29 by a pressure roller 45, whereby the fixing roller 29 is cleaned. The web 46 is taken up as needed by an unshown take-up apparatus to prevent the toner from building up at the contact point.

This machine is capable of forming the image on both surfaces of the recording material, by means of running the same recording material twice, wherein for the first run, the toner image is transferred onto one of the surfaces of the recording material, and after this toner image is fixed by the fixing apparatus, the same recording material is fed second time into this electrophotographic color copying machine, in a manner so as for the surface with the fixed toner image to face the circumferential surface of the transfer drum, whereby the toner image is transferred onto the other surface of the recording material, and is fixed in the same manner, producing a copy having the image on both surfaces, after the second run.

When it is necessary to form the image on both surfaces of the recording material, the recording material is placed on a tray T by an operator, as shown in FIG. 6, and is run through the apparatus, during which the toner image is transferred and fixed on one of the surfaces of the recording material, and is discharged. Then, the same recording material is again placed in the tray T by the operator, in a manner so as for the image to be formed on the opposite surface, this time, and is discharged after going through the image forming operation.

Next, referring to FIG. 1, the pressing means 18 and a driving means for placing the pressing means 18 in contact with, or moving it away from, the transfer drum, will be more specifically described.

As shown in FIG. 1, the elastic pressing member 18 is located in the region where the photosensitive drum 3 and the transfer drum 9 make contact, as well as within a corona discharge range of the transfer charger 10. It extends toward the dielectric sheet 93, leaning in the downstream direction from the upstream side of the dielectric sheet 93 (in the same direction as the transfer drum rotates) in such a manner that the distance between the pressing member 18 and the dielectric sheet 93 gradually diminishes. The dielectric sheet 93 is made of polyvinylidene fluoride resin (PVdF) or the like and serves as the recording material carrying member. Its thickness is approximately 25 μm to 2000 μm. The pressing member 18 is a pressure generating sheet composed of synthetic resin such as polyethylene, polypropylene, polyester, polyethylene terephthalate, or the like, and is placed across the transfer station. The volume resistivities of these resin films are no less than $10_{14}$ Ω.cm. In this embodiment, polyethylene terephthalate resin is employed. The dielectric sheet is fixed to the connecting member 9*c*, at the leading and trailing ends.

The pressing sheet 18 presses the dielectric sheet 93 by its own elasticity, herein the tip of the pressing sheet 18 on the dielectric sheet side is positioned on the dielectric sheet, at a location where the contact between the transfer material P and the photosensitive drum ends or begins, or another location extremely close to the preceding location.

If all needed is to press the dielectric sheet 93, provision of a backup member 18 suffices, which extends from the side opposite to the ingress side of the dielectric sheet 93, toward the upstream side with reference to the rotational direction of the dielectric sheet 93 (counter direction to the rotational direction of the transfer drum). However, such a structure is not effective to prevent the toner, which composes the image, from being scattered. This scattering of the toner is caused when the transfer occurs before the photosensitive drum comes in contact with the recording material. Therefore, it is preferable for the pressing member 18 to be extended from the ingress side of the dielectric sheet 93 toward the downstream side, with reference to the rotational direction of the dielectric sheet 93, in such a manner that the distance between the pressing member 18 and the dielectric sheet 93 gradually diminishes.

Further, in this embodiment, a driving means is provided for placing the pressing member 18 in contact with, or moving it away from, the dielectric sheet 93.

The driving means comprises: linking members 181, 182, and 183 for supporting the pressing member 18; a cam 185 for pivoting the linking member 183 about an axis 183*a*; a motor 186 for rotating the cam 185; and a tension spring 184, that is, a flexible holding means stretched between a bracket 24 and the linking member 181, for generating an elastic force in the direction to separate the pressing member 18 from the recording material carrying member 93. The motor 186 is driven in response to a signal from the control of the main assembly (unshown), asynchronously with the rotation of the transfer drum 9.

Next, referring to FIG. 2, an image forming operation carried out with use of the above mentioned structure will be described, with reference to the primary charge, exposure, development, transfer charge, and contacting and separating movement of the pressing member 18 driven by the motor 186, on the basis of the rotation of the transfer drum 9.

FIG. 2 is one example of timing charts for a case in which the size of the recording material P carried on the transfer drum 9 is, for example, A4. In this case, the recording material is arranged to make its shorter edge substantially parallel to the rotational direction of the transfer drum.

First, in order to form a magenta (M) image, the corona discharged is induced by the primary charger 4, whereby the surface of the photosensitive drum 3 is uniformly charged. Then, a laser beam is irradiated in response to the imaging data, whereby a latent M image is formed on the photosensitive drum 3.

In the developing station, a magenta developing device 1M, which has been on standby after having been moved into the developing station in advance, develops the M image. The development process by the device 1M is started t seconds earlier than the arrival of the leading end of the image at the developing station, in consideration of a transient time t which is required for a developing agent carrying member, that is, a developing sleeve, for carrying the developing agent held in the developing device, to start In the transfer station, the transfer charger is activated to induce a transfer corona discharge, substantially in synchronization with the arrival of the recording material carried on the transfer drum 9 at the transfer station, and the movement of the connecting member 9*c* of the transfer drum 9. The pressing member 18 comes in contact with the dielectric sheet 93, slightly before, or at the same time as this activation of the transfer charger, whereby the dielectric sheet 93 is pressed upon the photosensitive drum 3. Meanwhile, the transfer drum rotates almost one rotation, transferring the M image onto the recording material. The transfer charger is correspondingly activated while the recording material is in the transfer station.

At the moment the pressing member 18 is placed in contact with the dielectric sheet 93, vibration is generated by the contact. As is clearly understood from FIG. 2, if excessive vibration is generated while the photosensitive drum 3 is exposed to form the latent image, it affects the image forming process, producing an inferior image displaying irregular pitch or the like. Therefore, it is preferable to provide such a structure as is shown in this embodiment in which the motor and cam are combined to place smoothly the pressing member 18 in contact with the dielectric sheet 93, so that the least amount of vibration is generated. In case a tension generating mechanism incorporating, for example, a tension spring and a solenoid, to simplify the structure is used, it is preferable that the recording material is carried on the transfer drum from the connecting member by the gripper 9*e* on the connecting member, or that it is carried on the transfer dram from the neighborhood of the connecting member 9*c* by electrostatic force of attraction corona charger or the like, so that the pressing member is abutted to the drum when the connecting member is faced thereto. Further, it is preferable to provide a shock absorbing member, for example, a sponge piece, on the pressing member 18 side of the connecting member 9*c*, for reducing the vibration caused when the pressing member 18 comes in contact with the transfer drum, as much as possible.

While the transfer drum is rotating second time, the rotary developing apparatus 1 is rotated to position the cyan developing device 1C at the developing station to prepare for the development of the cyan (C) image. Then, while the transfer drum is rotating third time, the aforementioned process is repeated to transfer the C image onto the recording material.

The same process is repeated for a yellow image and a black image, whereby an image composed of four superimposed images of different color is formed on the recording material carried on the transfer drum. The pressing member 18 is separated from the dielectric sheet 93 by the aforementioned mechanism substantially the same time as when the trailing end of the recording material leaves the transfer station after being subjected to the sequences of transfer processes for four colors, and then, it is put on standby. In this state of being on standby, the pressing member 18 is not in contact with the dielectric sheet 93, in other words, no pressure is imparted on the dielectric sheet 93, holding an approximately 100 μm gap from the dielectric sheet 93.

At approximately the same time as when the fourth toner image, that is, the black image, begins to be transferred, the charge removing charger 11 and 13 are activated, whereby the charge is removed from the dielectric sheet 93 during the sixth and seventh rotations of the transfer drum.

When an image is formed on both surfaces of the recording material using a conventional color image forming apparatus, the oil, which adheres to the surface on which the image is fixed during the first run of the recording material, migrates onto the dielectric sheet during the second run when the image is formed on the opposite surface. Then, this oil, which is now on the transfer drum, migrates, this time, onto the photosensitive drum, since the dielectric sheet, which now has the oil on the surface, is directly pressed on the photosensitive drum by the pressing member 18. This second oil migration occurs during the rotation immediately after the completion of the toner image transfer, that is, a so-called post-rotation of the photosensitive drum, or during the rotation immediately before the beginning of the image transfer onto the second surface, that is, a so-called pre-rotation. As a result, an inferior image is produced. However, in this embodiment, the pressing member 18 is put on standby during the pre- or post-rotation when the dielectric sheet and the photosensitive drum 3 come into direct contact with each other, so that the contact between two drums is prevented as much as possible therefore, the inferior image produced by the migration of the oil onto the photosensitive drum is prevented. Further, in this embodiment, there are periods in which the pressing member 18 is placed in contact with the dielectric sheet 93 when the recording material is not in the transfer station, during the transfer processes for four images. However, during these periods, the toner charged to a polarity opposite to the normal toner, that is, the fog causing toner, is adhering to the photosensitive drum; therefore, it is difficult for the dielectric sheet 93 and photosensitive drum 3 to have a strong contact, reducing thereby the oil migration from the dielectric sheet 93 to the photosensitive drum 3.

Figure 3:
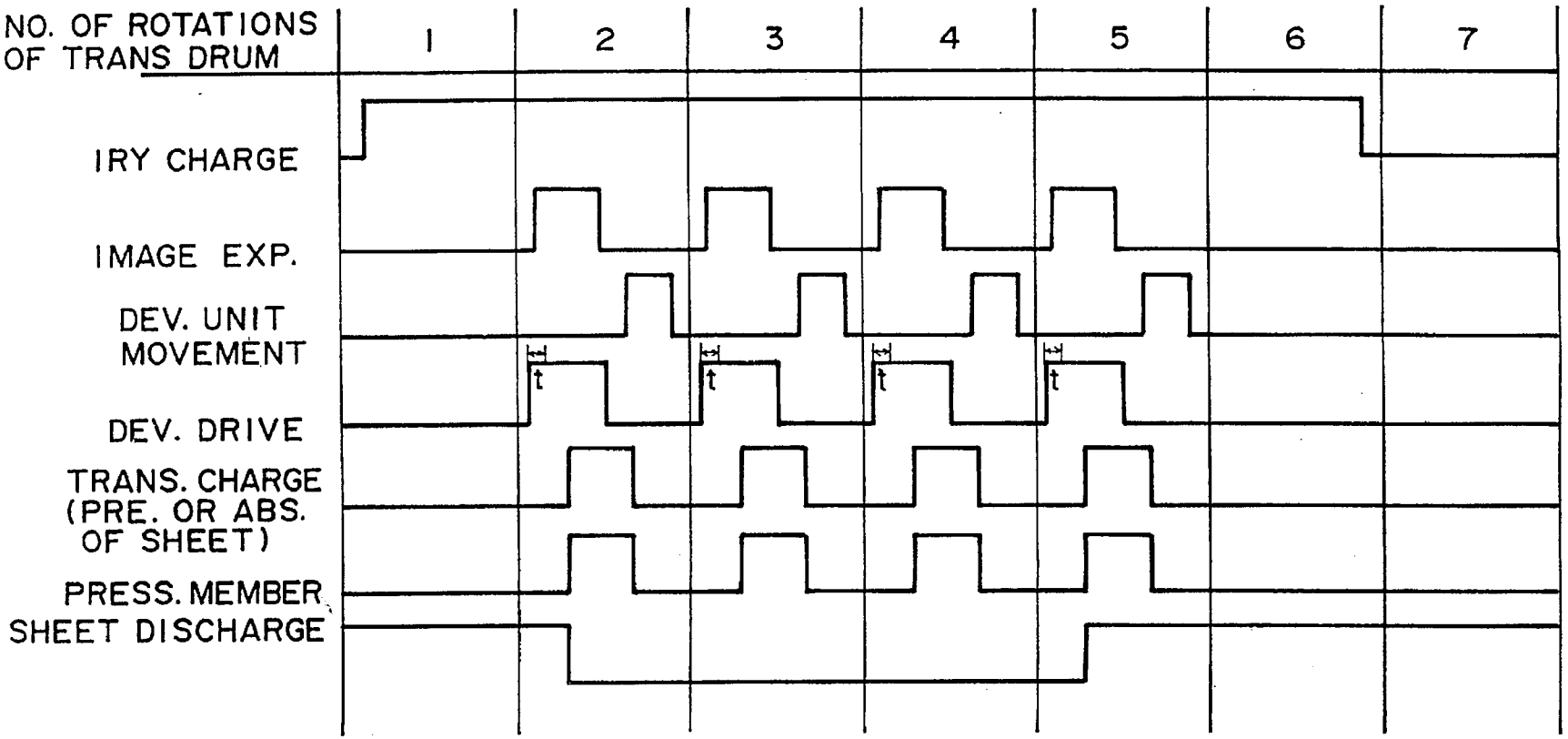
FIG. 3 is an alternative operational sequence of the image forming apparatus in accordance with the present invention.

Further, in this embodiment, the pressing member 18 is placed in contact with, or separated from, the dielectric sheet 93, with the timing as shown in FIG. 2. However, it may be placed in contact or separated, in synchronization with the transfer charge as shown in FIG. 3. In other words, if the surface of the dielectric sheet is perfectly prevented from contacting the photosensitive drum when the recording material is not on the dielectric sheet, it is needless to say that more preferable results can be obtained. In this case, however, the number of contacting and separating movements of the pressing member increases, causing more frequently the vibrations which occur during the moments of contact, whereby it is more liable for the inferior image having the pitch irregularity or the like to be produced. Therefore, it is preferable for the motor responsible for the movement of the pressing member to be controlled to slow down immediately before the pressing member comes in contact with the dielectric sheet, so that the contact vibration is prevented.

Figure 4:
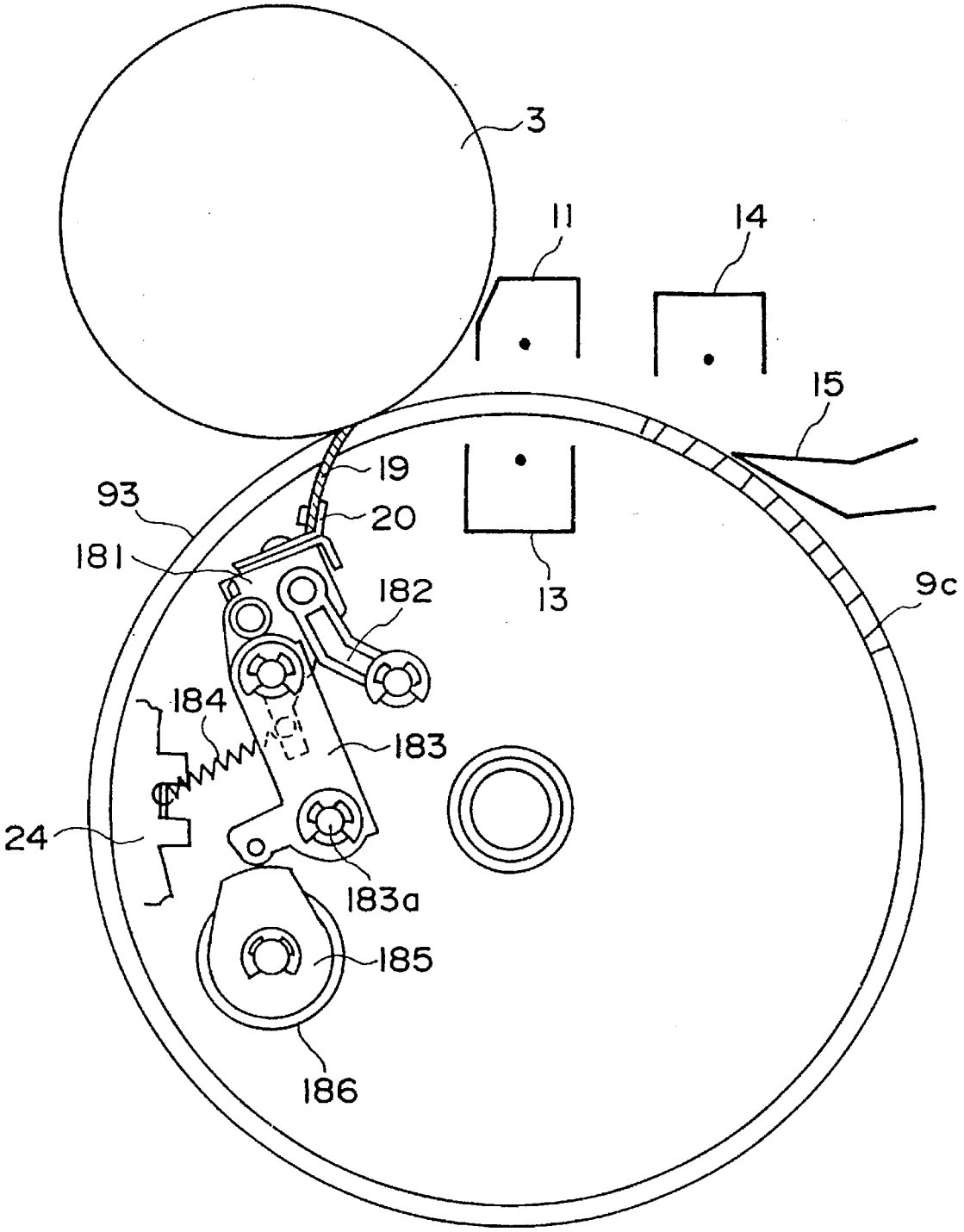
FIG. 4 is a sectional view of an alternative embodiment of the pressing member in the image forming apparatus in accordance with the present invention.
Figure 5:
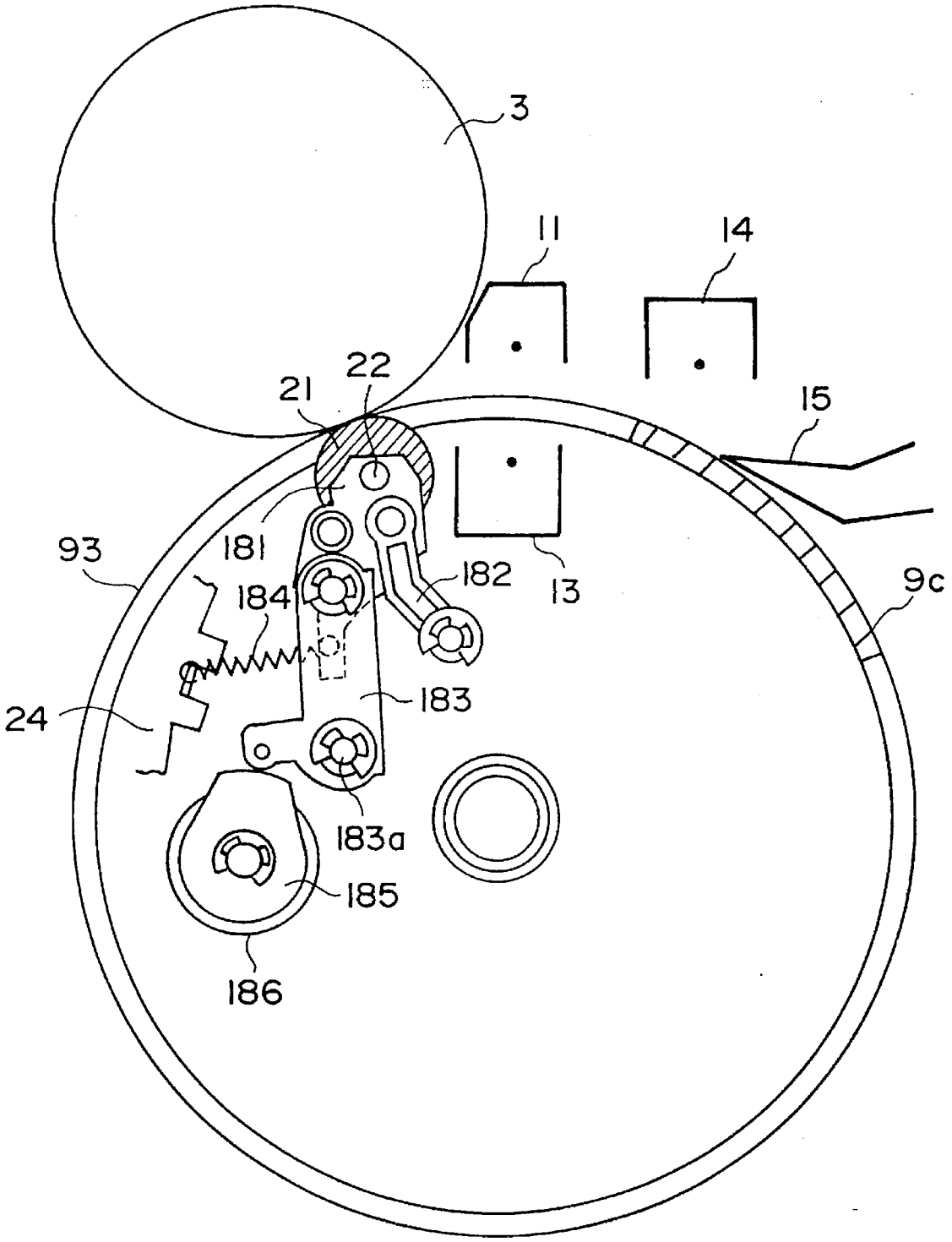
FIG. 5 is another alternative embodiment of the pressing member in the image forming apparatus in accordance with the present invention.

Further, in this embodiment, the transferring means comprises a transfer charger which induces a corona discharge to form a transferring electric field, and a pressing member. However, these two components may be replaced by a brush 19 having a volume resistivity of $10^{0}$–$10_{8}$ Ω.cm or a blade 19 having an volume resistivity equivalent to that of the brush 19, as shown in FIG. 4, wherein the brush 19 is composed of bound fiber material and is connected to an electrode to be imparted with a voltage. They may be also replaced by a rubber roller 21 which has a volume resistivity of equivalent value as the aforementioned brush, and is connected to an electrode 22 so that it can be imparted with a voltage, as shown in FIG. 5. The same advantageous effects as described above can be obtained by providing these transferring means with the mechanism for placing the transferring mean in contact with, or separating from, the dielectric sheet.

Next, an alternative embodiment for breaking the contact between the recording material carrying member and the photosensitive drum will be described.

Figure 11:
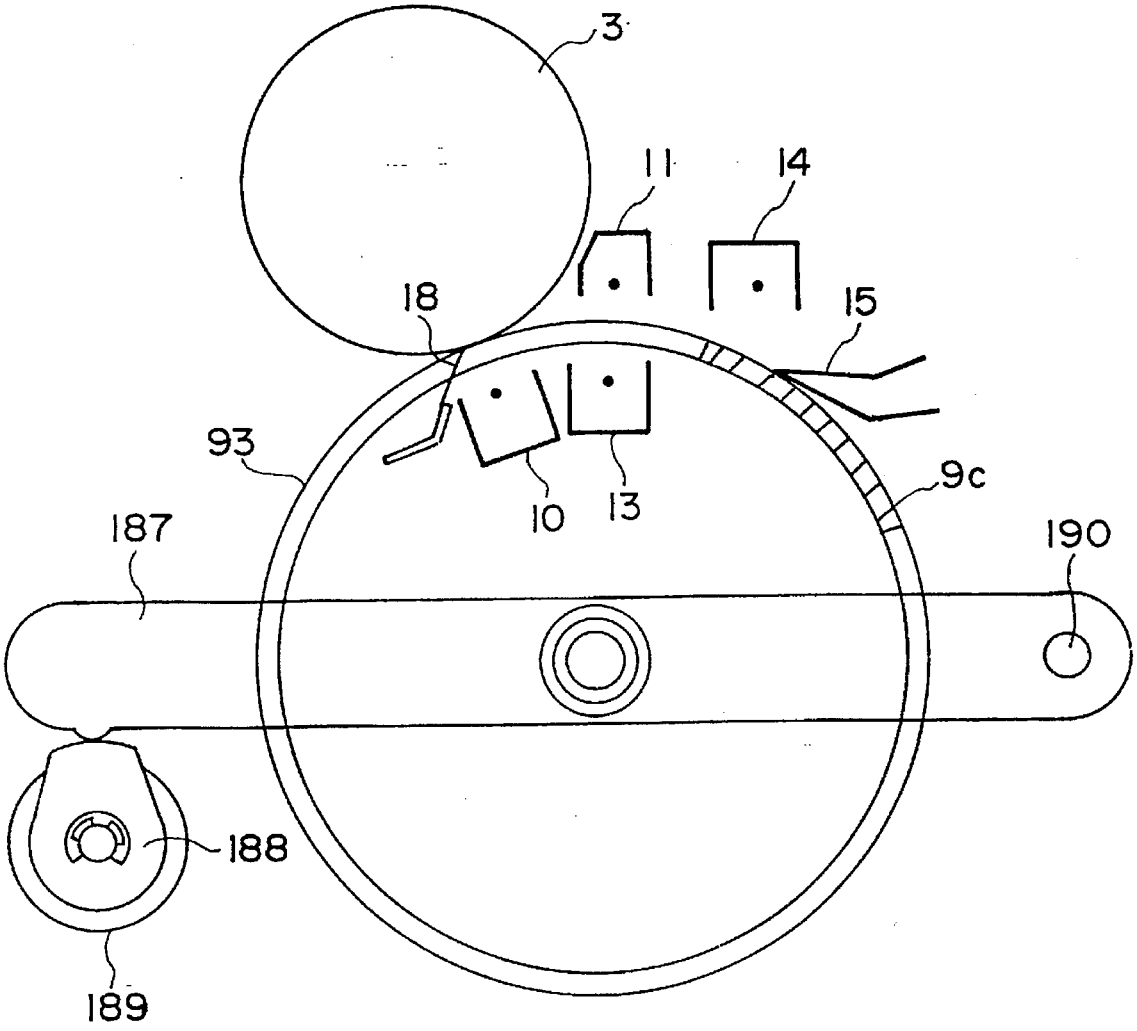
FIG. 11 is a sectional view of the essential portion of a mechanism for separating the recording material carrying member in the image forming apparatus in accordance with the present invention.

Referring to FIG. 11, in this alternative embodiment, the whole body of the transfer drum 9 is enabled to move away from the photosensitive drum 3, in the image forming apparatus described in the description of the preceding embodiment, as is evident from the drawing.

The driving means for enabling the transfer drum 9 to move away from the photosensitive drum 3 comprises, as shown in FIG. 11, a fixed axis 190, supporting member 187 fixed to the central axis of the transfer drum 9, cam 188 for causing the supporting member 187 to pivot about the axis 190, and motor 189 for rotating the cam 188.

Next, referring to FIG. 12, an image forming operation carried out with use of the above mentioned structure will be described, with reference to the primary charge, exposure, development, transfer charge, and contacting and separating movement of the pressing member 18 driven by the motor 186, on the basis of the rotation of the transfer drum 9.

Figure 12:
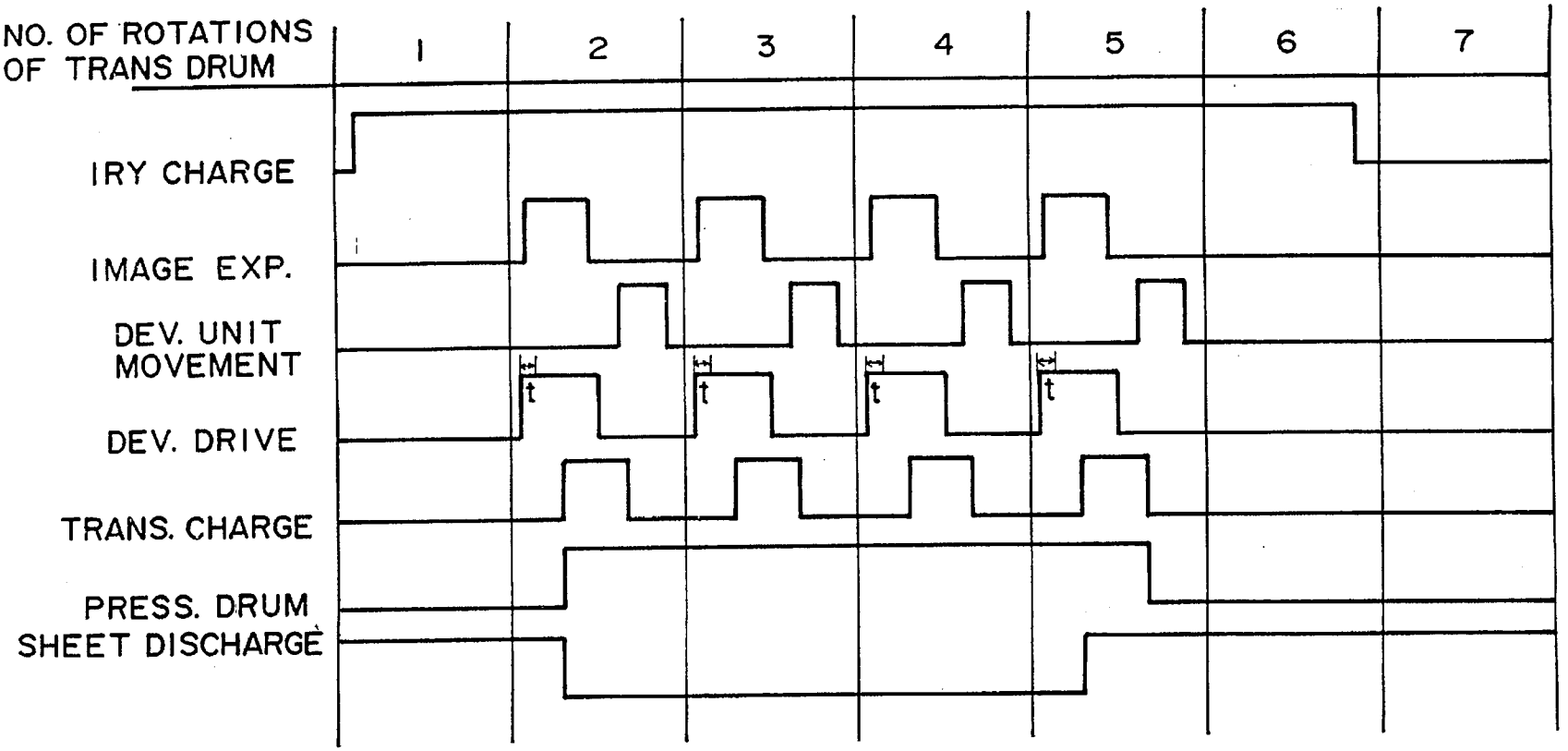
FIG. 12 is an operational sequence for the apparatus shown in FIG. 11.

FIG. 12 is one example of timing charts for a case in which the size of the recording material P carried on the transfer drum 9 is, for example, A4.

First, in order to form a magenta (M) image, the corona discharge is induced by the primary charger 4, whereby the surface of the photosensitive drum 3 is uniformly charged. Then, a laser beam is irradiated in response to the imaging data, whereby a latent M image is formed on the photosensitive drum 3.

In the developing station, a magenta developing device 1M, which has been on standby after having been moved into the developing station in advance, develops the M image. The development process by the device 1M is started t seconds earlier than the arrival of the leading end of the image at the developing station, in consideration of a transient time t which is required for a developing agent carrying member, that is, a developing sleeve, for carrying the developing agent held in the developing device, to start up.

In the transfer station, the transfer charger is activated to induce a transfer corona discharge, substantially in synchronization with the arrival of the recording material carried on the transfer drum 9 at the transfer station, and the movement of the connecting member 9*c* of the transfer drum 9. The pressing member 18 comes in contact with the dielectric sheet 93, slightly before, or at the same time as this activation of the transfer charger, whereby the dielectric sheet 93 is pressed upon the photosensitive drum 3. Meanwhile, the transfer drum rotates almost one rotation, transferring the M image onto the recording material. The transfer charger is correspondingly activated while the recording material is in the transfer station. While the transfer drum is rotating second time, the rotary developing apparatus 1 is rotated to position the cyan developing device 1C at the developing station to prepare for the development of the cyan (C) image. Then, while the transfer drum is rotating third time, the aforementioned process is repeated to transfer the C image onto the recording material.

The same process is repeated for a yellow image and a black image, whereby an image composed of four superimposed images of different color is formed on the recording material carried on the transfer drum. The pressing member 18 is separated from the dielectric sheet 93 by the aforementioned mechanism substantially the same time as when the trailing end of the recording material leaves the transfer station after being subjected to the sequences of transfer processes for four colors, and then, it is put on standby. In this state of being on standby, the pressing member 18 is not in contact with the dielectric sheet 93, in other words, no pressure is imparted on the dielectric sheet 93, holding an approximately 100 μm gap from the dielectric sheet 93.

With such a structure in place, the direct contact between the recording material carrying sheet on which the oil is adhering, and the photosensitive drum is reduced as much as possible as in the preceding embodiment. Therefore, it becomes possible to prevent the image deterioration which occurs in the prior machine because of the adhesion of the oil to the photosensitive drum.

In the preceding embodiments, the oil migrates from the recording material to the transfer drum while the image is formed on the second side of the recording material. Therefore, in order to prevent the oil migration to the photosensitive drum, it is preferable to break the contact between the photosensitive drum and the transfer drum after the image transfer onto the second surface. More specifically, it is preferable to break the contact between the recording material carrying member of the transfer drum and the photosensitive drum at least during the post-rotation after the completion of the image formation on the second side of the recording material. Referring to the sequences in FIGS. 2 and 3, it is preferable to separate these two components immediately after the trailing end of the recording material leaves the transfer station at the end of the transfer operation for the fourth color. If the oil adhering to the transfer drum is cleaned by a cleaning member during this post-rotation, the amount oil which is still adhering to the transfer drum during the pre-rotation of the following image formation is substantially smaller; therefore, the transfer drum and photosensitive drum may have a contact.

Figure 13:
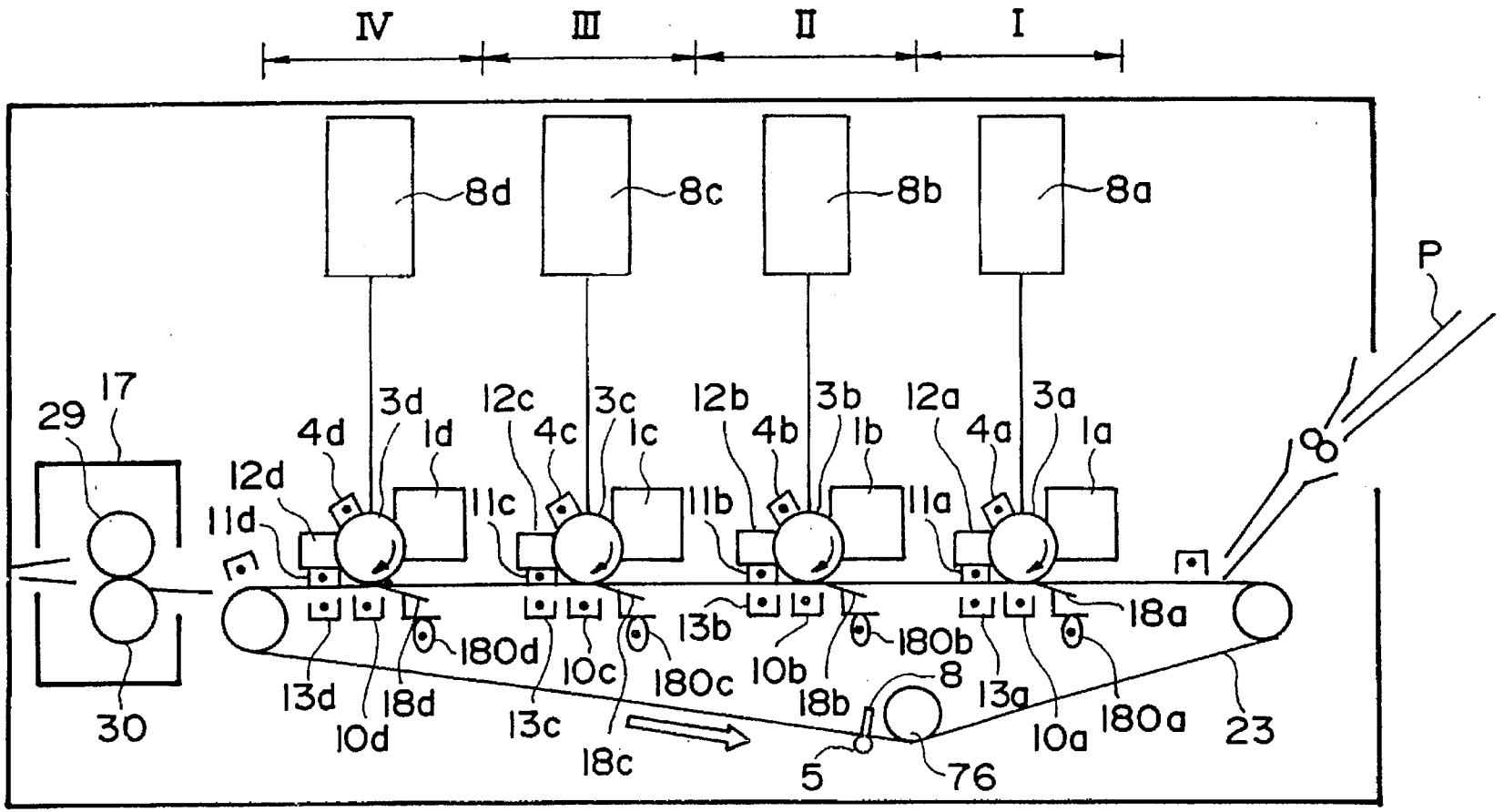
FIG. 13 is a sectional view of an alternative embodiment of the image forming apparatus in accordance with the present invention.

Further, referring to FIG. 13, the present invention can be embodied in an electrophotographic multicolor copying machine comprising four image forming units I to IV.

In this embodiment, the image forming units I to IV comprise photosensitive drums 3*a* to 3*d*, respectively, which are surrounded by primary chargers 4*a* to 4*d*, exposing means 8*a* to 8*d*, developing devices 1*a* to 1*d*, transfer chargers 10*a* to 10*d*, charge removing chargers 11*a* to 11*d*, charge removing chargers 13*a* to 13*d*, and cleaners 12*a* to 12*d*. In addition, a conveying means 23 in a form of an endless belt is extended through these four image forming units, at the underside of the photosensitive drums.

Further, pressing member 18*a* to 18*d* as pressure generating means for pressing the conveying means 23 in a form of an endless belt toward the photosensitive drum are disposed within respective corona discharge inducing ranges of the transfer chargers 10*a* to 10*d*. Also, next to these pressing members 18*a* to 18*d*, mechanisms 180*a* to 180*d* for placing these pressing members in contact with, or moving them away from, the conveying means 23 are provided.

In this embodiment, the activation of the transfer charger of each image forming unit and the placement of the pressing member in contact with the conveying means are timed with the arrival of the leading end of the recording material at the transfer station of a pertaining image forming unit. Then, at approximately the same time as when the recording material comes out of each transfer station, the pertaining transfer charger is deactivated, and also, the pertaining pressing member is separated. In this case, while the pressing member is away from the conveying means, the photosensitive drum and the conveying means (transfer belt) is apart from each other.

With such a structure in place, it is possible to prevent the image deterioration caused by the oil migration from the surface of the conveying means in a form of an endless belt to the photosensitive drum, after the image is formed on both surface of the recording material.

Figure 14:
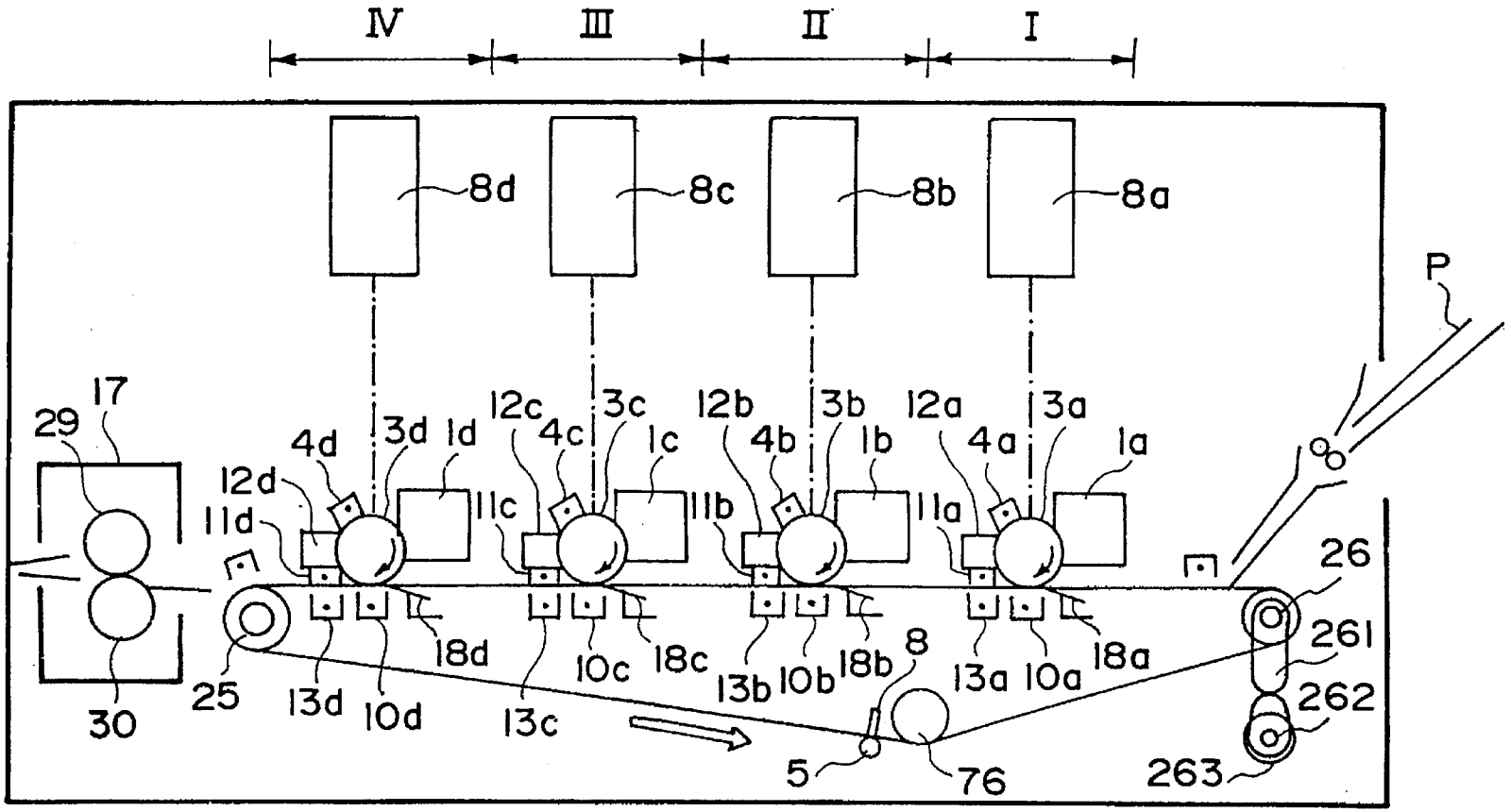
FIG. 14 is a sectional view of another alternative embodiment of the image forming apparatus in accordance with the present invention.

Further, in another alternative embodiment shown in FIG. 14, instead of breaking the contact between the photosensitive drum and the conveyer belt by moving the pressing member away from the conveyer belt, the whole body of the recording material conveyer belt unit is enabled to move to come in contact with, or to separate from, the photosensitive drums 3*a* to 3*d*, as is evident from the drawing, in the image forming apparatus described in the description of the preceding embodiments.

As shown in FIG. 14, the driving means for moving the whole body of the conveyer belt unit toward, or away from, the photosensitive drum comprises rollers 25 and 26 which support the conveyer belt, a supporting member 261 fixed to the axis of the roller 26, a cam 262 for moving vertically the supporting member 261, and a motor 263 for rotating the cam 262.

With such a structure in place, the conveyer belt unit is placed in contact with the photosensitive drums 3*a* to 3*d* by the function of the aforementioned conveyer belt driving means, at the same time as when, or immediately before, the recording material fed onto the conveyer belt from a sheet feeding station arrives at the transfer station of the first image forming unit. Then, the transfer corona discharge is induced, whereby the magenta image is transferred. Thereafter, rest of images are sequentially transferred through respective image forming units, wherein at approximately the same time as when the recording material comes out of the fourth image forming unit, the conveyer belt unit is moved away from the photosensitive drum by the function of the conveyer belt driving means.

With provision of such a structure, it is possible to prevent the image deterioration caused by the oil migration from the surface of the conveying means in a form of a belt onto the photosensitive drum.

In the embodiments shown in FIGS. 13 and 14, the oil migrates from the recording material to the transfer drum while the image is formed on the second side of the recording material. Therefore, in order to prevent the oil migration from the conveyer belt to the photosensitive drum, it is preferable to break the contact between the photosensitive drum and the conveyer belt after the image transfer onto the second surface. More specifically, it is preferable to break the contact between the conveyer belt and the photosensitive drum at least during the post-rotation after the completion of the image formation on the second side of the recording material. If the oil adhering to the conveyer belt is cleaned during this post-rotation, there will be practically no oil adhering to the conveyer belt during the pre-rotation of the following image formation; therefore, the conveyer belt and photosensitive drum may have a contact.

Figure 15:
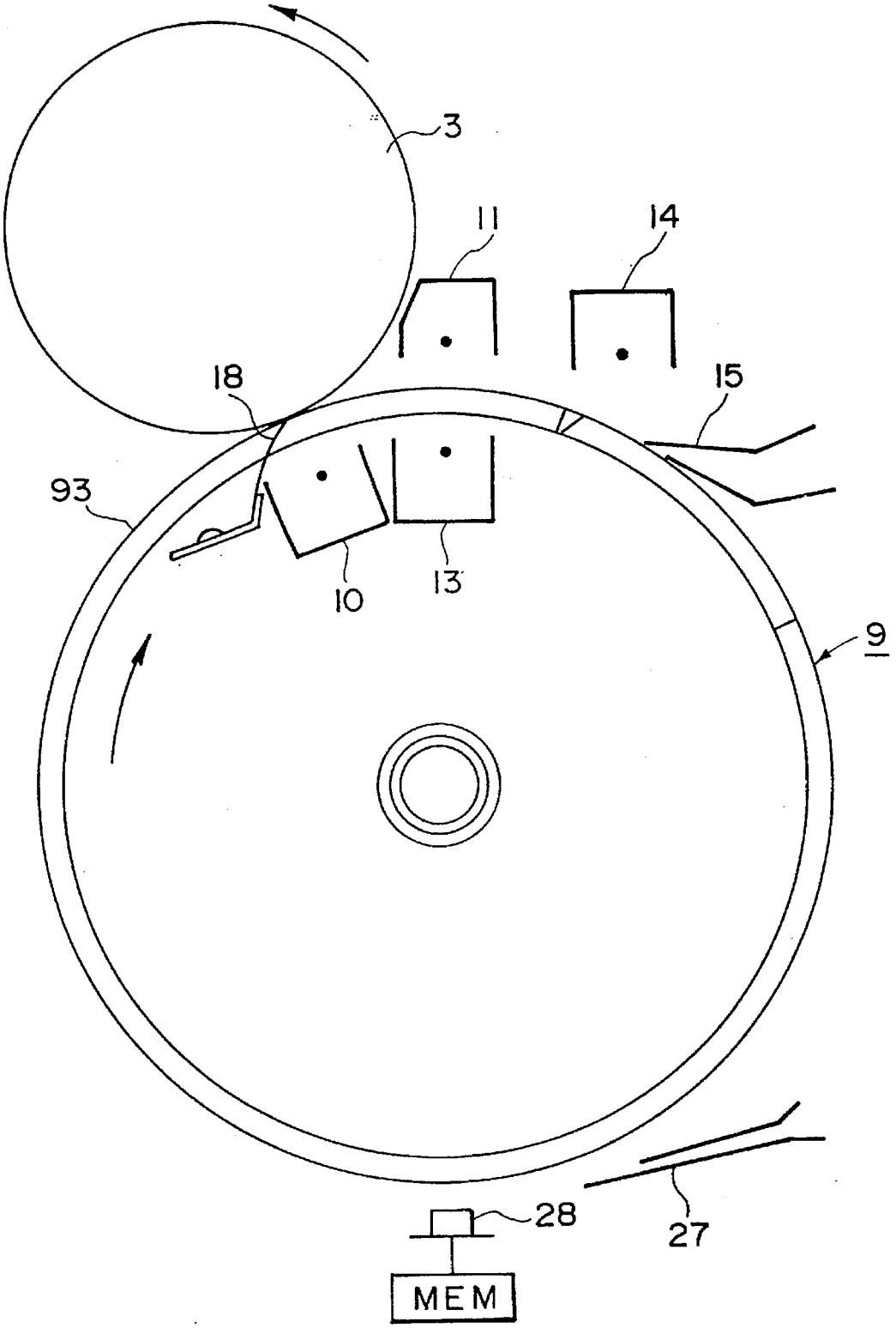
FIG. 15 is a sectional view of the essential portion of a further alternative embodiment of the present invention.

FIG. 15 illustrates another alternative embodiment of the present invention. As a result of continuous research, this inventor and his colleagues made the following discovery. In other words, it was found out that much better results could be obtained if the pressing member 18 was made to come in contact with, or separate from, the dielectric sheet 93 in response to a signal from a position sensing member 28, wherein the position sensing member 28 was a sensor disposed adjacent to the transfer drum 9, as shown in FIG. 15, for detecting where on the transfer drum the transfer material was located. Hereinafter, this discovery will be described in detail.

As will be understood from FIG. 15, according to this embodiment, the transfer material position detecting member 28 is disposed adjacent to the transfer drum 9, between the guide plate 27 and the transfer station, wherein the transfer drum 9 is constructed by connecting integrally the coaxially positioned cylindrical members 9*a* and 9*b* with the connecting member 9*c*, and the guide plate 27 constitutes a portion of the recording material conveying system.

The recording material guided to the transfer drum 9 by the guide plate 27 is attracted onto the dielectric sheet 93 by an electrostatic means (unshown). The attracted recording material follows the movement of the transfer drum. When the leading end of the recording material passes by the transfer material position detecting member 28, the position of the leading end of the recording material is stored in a memory device. Thereafter, the recording material continues its movement, and when its trailing end passes the recording material position detecting member 28, the position of the trailing end is stored in the memory device of the main assembly.

Then, by processing the positional data of the leading and trailing ends of the recording material stored in the memory device, and the distance data or the like from the recording material position detecting member 28 to the transfer station, the pressing member 18 is made to come in contact with the dielectric sheet 93 at the right moment when the leading end of the recording material arrive at the transfer station, and also, the pressing member 18 is quickly separated as soon as the trailing end of the recording material comes out of the transfer station, to be put on standby.

With provision of such a structure, the image deterioration can be prevented as well as in the preceding embodiments, regardless of the size of the recording material, and even when the position of the recording material on the recording material carrying member is slightly off.

Figure 16:
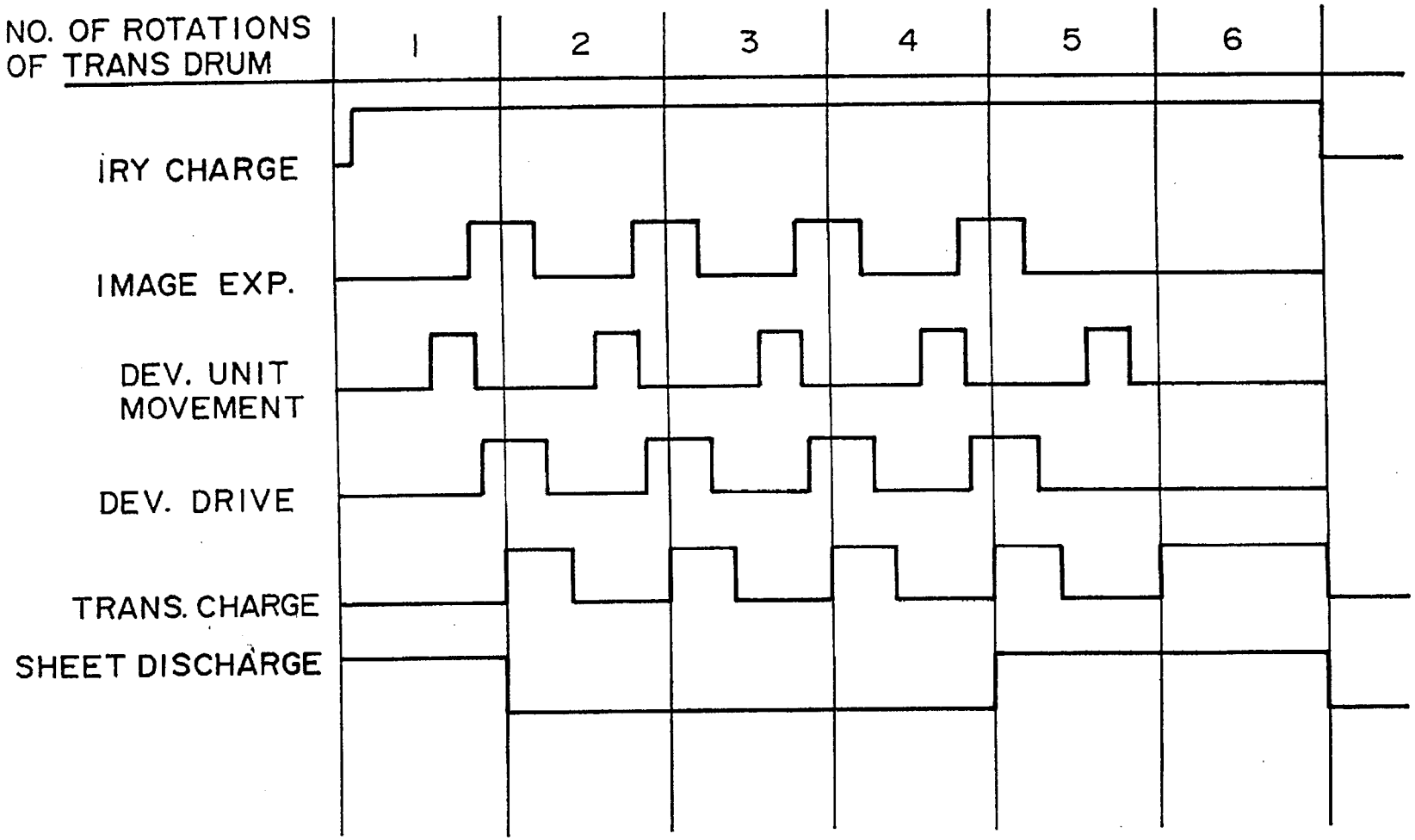
FIG. 16 is an operational sequence of the image forming apparatus in accordance with the present invention.

On the other hand, the transfer charger 10 may be activated second time after the fourth color image is transferred, as shown in FIG. 16. As for the transfer corona discharge induced by the charger 10, while the transfer drum 9 is rotating one rotation after the completion of the transfer of the BK image, that is, while the transfer drum 9 is rotating the sixth rotation in FIG. 16, the transfer corona discharge is induced second time for a duration equivalent to the time it takes for the transfer drum 9 to rotate approximately once. Then, at approximately the same time as when the sixth rotation of the transfer drum 9, during which the transfer charger remains activated, is completed, the charge removing chargers 11 and 13 are also deactivated, ending the process of removing the charge from the recording material.

The reason why the transfer drum 9 is charged after the completion of the transfer charge for the fourth color, for the duration equivalent to the time it takes for the transfer drum 9 to rotate approximately once, is as follows. When an image is transferred onto a recording material P, of which length is shorter than the circumference of the transfer drum 9 on which the recording material P is carried, for example, when the image is transferred onto an A4 size sheet of paper, as shown here, it is common practice to charge the transfer drum 9 only where the recording material P contacts, in order not to generate a transfer charge memory on the photosensitive drum 3, or the like.

Further, in order to shorten the time required for a continuous image forming operation as much as possible, such a method is often adopted that during the immediate rotation of the transfer drum 9 after the completion of the transfer charge of the recording material P for the fourth color image, the transfer drum 9 is charged for the transfer operation for the following recording material P on which the first color image is transferred. In other words, referring to FIG. 16, the M image is transferred during the sixth rotation immediately after the completion of the BK image transfer carried out during the fifth rotation of the transfer drum. Such a practice results in charging the recording material carrying sheet 93, only where the recording material P is on, whereby the recording material carrying sheet 93 gradually develops charge memory. After approximately 300 copies are continuously made, this charge memory begins failing to de erased by a charge removing process carried out only once after the completion of the image transfer. In order to erase this memory, it is effective to charge entirely the recording material carrying sheet 93.

This is why the transfer charger is activated for the duration equivalent to the time it takes for the transfer drum 9 to rotate approximately once, after the recording material P is charged for transferring the fourth color image during the continuous image forming operation.

When an image is formed on both surfaces of the recording material using such a structure, the recording material carrying sheet 93 ceases to be electrostatically attracted to the photosensitive drum 3, since the recording material carrying sheet 93 is subjected to the charge from the transfer charger, after the completion of the toner image transfer, that is, during the post-rotation. As a result, the separating agent 41 (oil) which migrates from the recording material P to the recording material carrying sheet 93 can be prevented from migrating onto the photosensitive drum 3, whereby the image deterioration can be prevented.

Contrarily, in another alternative embodiment in which the transfer charger 10 is turned off after the image transfer, as shown in FIG. 2, so that transfer electric field is not generated, the sheet count setting for continuously feedable recording materials is limited not to exceed 99.

Since the upper limit of the number of the continuously feedable recording materials is set at 99, the charge memory does not strongly develop on the recording material carrying sheet 93, and therefore, it ceases to occur that the weakly developed memory cannot be erased by the charge removing charge alone. As a result, the problem can be avoided, which might occur because the recording material carrying sheet 93 is not entirely subjected to the second transfer corona discharge from the transfer charger, during the post-rotation.

In this embodiment, resin film having a volume resistivity of $1\times10^{13}$–$1\times10^{14}$ Ω.cm is used as the recording material carrying sheet 93, wherein such resin film is produced by mixing conductive particle such as carbon particle in polyvinylidene fluoride or polycarbonate resin. Other structures or image forming sequence is the same as those for the preceding embodiments.

Provision of such a structure enables the image formation on both surfaces of the recording material, without the image deterioration. Further, since the volume resistivity of the recording material carrying sheet 93 is set at $1\times10^{13}$–$1\times10^{14}$ Ω.cm, which is slightly lower than usual, the charge memory which may otherwise develops on the recording material carrying sheet 93 as a result of the transfer charge can be prevented. Therefore, it is possible to set a higher limit for the number of continuously feedable recording materials, making the apparatus more convenient to use.

Incidentally, in this embodiment, the upper limit for the number of the continuously feedable recording materials is 999.

In the preceding embodiments, after the image is formed on one of the surfaces of the recording material, the recording material is turned over and placed in the tray by the operator so that the image is formed on the other surface of the recording material. However, such a manual operation may be replaced by provision of a conveying passage which, after the image is formed on the fire surface of the recording material, automatically turns over the recording material and delivers it to the transfer station, for the image formation on the second surface.

While the invention has been described with reference to the structures disclosed therein, it is not confined to the details set forth and this application is intended to cover such modifications or changes as may come within the purposes of the improvements or the scope of the hollowing claims.

What is claimed is:

1. An image forming apparatus, comprising:

an image bearing member for bearing toner images of different colors;

means for sequentially forming the toner images of different colors on said image bearing member;

a transfer material carrying member for carrying a transfer material onto which the toner images are sequentially transferred at a transfer position;

a rotary fixing member which is coated with a parting agent, for contact with an unfixed image on the transfer material;

a backup member for forming a nip in conjunction with said rotary fixing member, wherein the transfer material is conveyed through the nip to fix the image onto the transfer material;

wherein said image forming apparatus is capable of forming an image on a second surface of said transfer material after the toner image is fixed on a first surface of said transfer material;

driving means for maintaining contact between said image bearing member and said transfer material carrying member from a start of image transfer for a first color onto a said transfer material to completion of image transfer for a last color onto said transfer material, and for separating said image bearing member and said transfer material carrying member from each other after the completion of the image transfer for the last color onto the said transfer material; and toner supply means for supplying toner to said image bearing member such that said image bearing member and said transfer material carrying member are urged toward each other with the toner therebetween in a period from a start of image transfer for the first color onto a said transfer material to an end of image transfer for the last color thereby avoiding undue contacting or separating operation between the image bearing member and said transfer material carrying member.

2. An image forming apparatus according to claim 1, wherein said driving means separates said image bearing member and said transfer material carrying member at substantially the same time as when the image transfer for the last color onto the said transfer material is completed.

3. An apparatus according to claim 1 or 2, wherein said driving means urges said image bearing member and said transfer material carrying member toward each other substantially simultaneously with the start of image transfer of the toner image for the first color onto the said transfer material.

4. An apparatus according to claim 1, wherein said driving means moves a pressing member for pressing said transfer material carrying member to said image bearing member, toward and away from said transfer material carrying member.

5. An apparatus according to claim 4, wherein said pressing member is supplied with a voltage to transfer the toner image on said image bearing member onto the transfer material carried on said transfer material carrying member by application of charge to said transfer material carrying member.

6. An image forming apparatus according to claim 1 or 4, further comprising transfer charge applying means for charging said transfer material carrying member in order to transfer the toner image borne on said image bearing member onto transfer material carried on said transfer material carrying member.

7. An image forming apparatus according to claim 6, wherein said transfer charge applying means is deactivated after the completion of the image transfer onto the said transfer material for the last color.

8. An image forming apparatus according to claim 7, wherein said transfer charge applying means is deactivated in close proximity to the time as when the image transfer for the last color onto the said transfer material is completed.

9. An apparatus according to claim 6, wherein said transfer charge applying means starts charge applying operation substantially simultaneously with start of the image transfer for the first color onto the said transfer material.

10. An apparatus according to claim 1, wherein said toner supplying means supplies toner having been charged to a polarity opposite from that of the toner image.

11. An apparatus according to claim 1, wherein the transfer material is automatically inverted for image formation on the second side.

12. An image forming apparatus, comprising:

an image bearing member for bearing toner images of different colors;

means for sequentially forming the toner images of different colors on said image bearing member;

a transfer material carrying member for carrying a transfer material onto which the toner images are sequentially transferred at a transfer position;

a rotary fixing member which is coated with a parting agent, for contact with an unfixed image on the transfer material;

a backup member for forming a nip in conjunction with said rotary fixing member, wherein the transfer material is conveyed through the nip to fix the image onto the transfer material;

wherein said image forming apparatus is capable of forming an image on a second surface of said transfer material after the toner image is fixed on a first surface of said transfer material;

driving means for maintaining contact between said image bearing member and said transfer material carrying member from a start of image transfer for a first color onto a said transfer material to completion of image transfer for last color onto said transfer material, and for separating said image bearing member and said transfer material carrying member from each other after the completion of the image transfer for the last color onto the said transfer material; and toner supply means for supplying toner to said image bearing member such that said image bearing member and said transfer material carrying member are urged toward each other with the toner therebetween, while no transfer material is present in said transfer position, in a period from a start of image transfer for the first color onto said transfer material to an end of image transfer for the last color.

13. An image forming apparatus according to claim 12, wherein said driving means separates said image bearing member and said transfer material carrying member at substantially the same time as when the image transfer for the last color onto the said transfer material is completed.

14. An apparatus according to claim 12 or 13, wherein said driving means urges said image bearing member and said transfer material carrying member toward each other substantially simultaneously with the start of image transfer of the toner image for the first color onto said transfer material.

15. An apparatus according to claim 12, wherein said driving means moves a pressing member for pressing said transfer material carrying member to said image bearing member toward and away from said transfer material carrying member.

16. An image forming apparatus according to claim 12 or 15, further comprising transfer charge applying means for charging said transfer material carrying member in order to transfer the toner image borne on said image bearing member onto transfer material carried on said transfer material carrying member.

17. An image forming apparatus according to claim 16, wherein said transfer charge applying means is deactivated after the completion of the image transfer onto the said transfer material for the last color.

18. An image forming apparatus according to claim 17, wherein said transfer charge applying means is deactivated in close proximity to the time as when the image transfer for the last color onto said transfer material is completed.

19. An apparatus according to claim 16, wherein said transfer charge applying means starts charge applying operation substantially simultaneously with start of the image transfer for the first color onto said transfer material.

20. An apparatus according to claim 15, wherein said pressing member is supplied with a voltage to transfer the toner image on said image bearing member onto the transfer material carried on said transfer material carrying member by application of charge to said transfer material carrying member.

21. An apparatus according to claim 12, wherein said toner supplying means supplies toner having been charged to a polarity opposite from that of the toner image.

22. An apparatus according to claim 12, wherein the transfer material is automatically inverted for image formation on the second side.

* * * * *

UNITED STATES PATENT AND TRADEMARK OFFICE

CERTIFICATE OF CORRECTION

PATENT NO. : 5,640,658
DATED : June 17, 1997
INVENTOR(S) : Masahiro INOUE, et al.

It is certified that error appears in the above-identified patent and that said Letters Patent is hereby corrected as shown below:

Column 1, line 57, delete "adheres" and insert therefor --adhere--.

Column 4, line 47, delete "t" and insert therefor --the--;
Line 48, delete "e".

Column 6, line 3, delete "$10_3$" and insert therefor --$10^3$--;
Line 4, delete "$10_2$" and insert therefor --$10^2$--.

Column 7, line 61, delete "$10_{14}$" and insert therefor --$10^{14}$--.

Column 9, line 22, delete "dram" and insert therefor --drum--.

Column 10, line 45, delete "$10_8$" and insert therefor --$10^8$--.

Column 14, line 64, delete "de" and insert therefor --be--.

Signed and Sealed this

Third Day of February, 1998

*Attest:*

BRUCE LEHMAN

*Attesting Officer*

*Commissioner of Patents and Trademarks*